United States Patent [19]

Johnson

[11] Patent Number: 4,528,793

[45] Date of Patent: Jul. 16, 1985

[54] METHOD OF CONSTRUCTING PRECAST CONCRETE BUILDING WITH DUCTILE CONCRETE FRAME

[76] Inventor: Delp W. Johnson, 240 Oakview Dr., San Carlos, Calif. 94070

[21] Appl. No.: 437,815

[22] Filed: Dec. 17, 1982

[51] Int. Cl.[3] ..... E04B 1/348; E04B 1/344

[52] U.S. Cl. ..... 52/745

[58] Field of Search ..... 52/236.7, 745, 251, 52/236.5, 236.8, 79.11, 747, 127.2, 125.1, 749, 252

[56] References Cited

U.S. PATENT DOCUMENTS

| | | | |
|---|---|---|---|
| 2,618,146 | 11/1952 | Ciarlini | 52/252 |
| 3,354,593 | 11/1967 | Zukas | 52/125.1 X |
| 3,494,092 | 2/1970 | Johnson et al. | 52/236.7 |
| 3,818,660 | 6/1974 | Dillon | 52/251 |
| 3,828,512 | 8/1974 | Johnson | 52/745 |
| 3,969,872 | 7/1976 | Weese | 52/745 |
| 4,001,992 | 1/1977 | Röhss | 52/251 |
| 4,301,630 | 11/1981 | Burkland | 52/745 X |
| 4,363,200 | 12/1982 | Goldenberg | 52/252 |
| 4,443,985 | 4/1984 | Moreno | 52/252 |

FOREIGN PATENT DOCUMENTS

| | | | |
|---|---|---|---|
| 1480279 | 4/1967 | France | 52/745 |

*Primary Examiner*—J. Karl Bell

[57] ABSTRACT

Method is disclosed for the construction of a concrete building utilizing precast floor slabs and in situ cast concrete columns, in which method, the forms for the columns are utilized to support the precast concrete floors and the columns are cast thru holes provided in the floor slabs, with the reinforcing of the slabs continuous thru the holes, and reinforcing for the columns continuous vertically for multi level buildings. In addition, means is disclosed for casting beams between the columns to provide a concrete frame which is made to function as a composite beam with the floor slab. In addition, means is disclosed to utilize the foldable concrete walls to provide lateral stability during the erection.

8 Claims, 4 Drawing Figures

FIG. 1
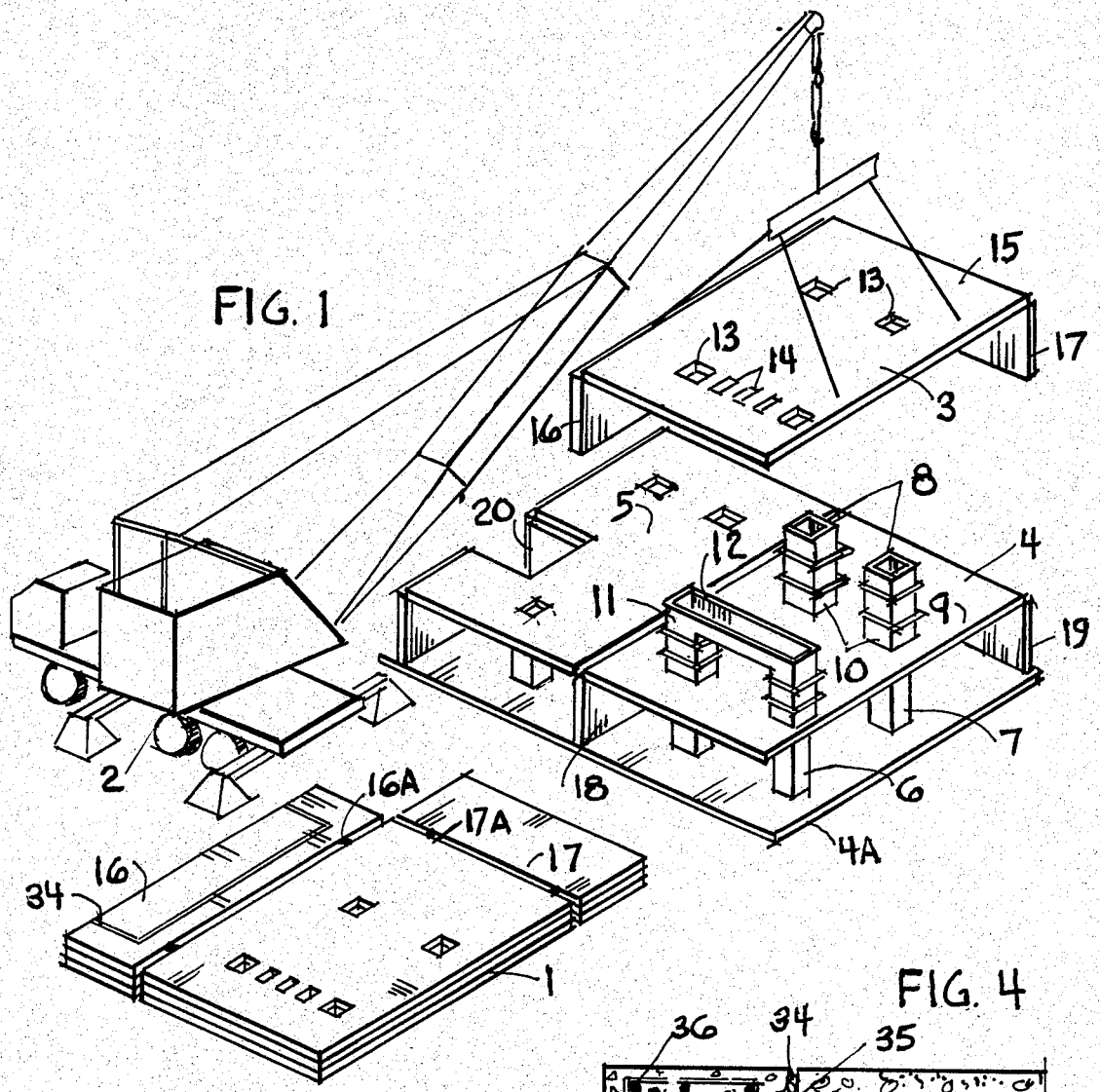
FIG. 4
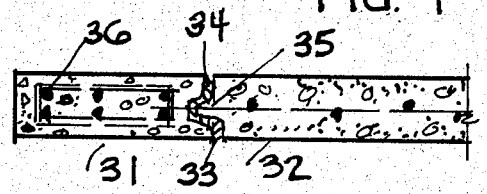
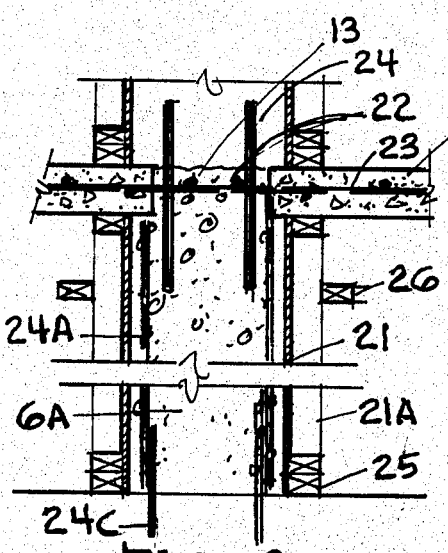
FIG. 2
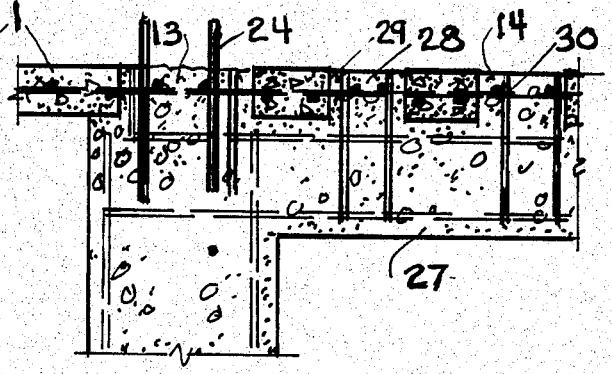
FIG. 3

METHOD OF CONSTRUCTING PRECAST CONCRETE BUILDING WITH DUCTILE CONCRETE FRAME

CROSS REFERENCE TO RELATED APPLICATIONS

There have been many efforts to develop precast concrete buildings, and many methods have been suggested and tried, including the systems as disclosed in patents of Johnson No. 3,492,092, Johnson No. 3,828,512, Harboe (Danish) No. 82,772, Miram No. 3,872,635, each of which relied on bearing concrete walls to provide vertical support and to serve as shear walls. Vertical continuity was provided by welded connections, or some ssort of grouted connections. In the application of Johnson No. 3,492,092 to a twelve story building in Oakland, Calif., Johnson did provide chases in concrete walls to permit installation of continuous vertical steel the full height of the building, which chases were then filled with grout and finished flush with the wall surface. In a project in Hawaii, also with Johnson '092, steel tube columns were utilized as permanent structural supports to provide interior support for long clear span floor slabs for a three story building. In each of these applications, the concrete walls provided all of the shear resistance for the total structure, which fact served to restrict the design. Currently, Oct. 1982, Johnson No. 3,828,512, is being utilized for U.S. Air Force housing for a 1000 unit two story housing project, where the system was selectd in a world wide design build competition competition over 70 competing contractors offering different systems. Two hundred of these units have been erected, and the the contract is proceeding on an additional 400 units. Now, the petitioner has been requested to design 12 to 20 story buildings with the system, and finds that the changes in building codes require improvements to the '092, and the '512 patents, and the system developed for their application. The existing patents require certain improvements as disclosed in the present invention to make them practical for buildings over 12 stories in height.

In addition, the availability of skilled workmen capable of producing accurate wall forms, is decreasing; and the field problems of supervision to assure that grouting has been properly done, that continuity welding done correctly, continue to mount. In addition, it is desirable to have a system which will avoid the condition of temporary metal shims, used to support the bearing walls until the grout has set. When they are left in the final building, stress concentration occur which may result in cracking of the bearing walls.

The present invention has been developed to overcome these difficulties, to provide the means of constructing buildomgs higher than 12 stories, and to provide other advantages as will be disclosed.

BRIEF DESCRIPTION OF THE INVENTION

The present invention discloses a new and novel method of constructing a concrete building, especially suitable for high rise construction. It provides for the use of precast concrete floor slabs in large sections. These sections are lifted floor by floor wher they are supported on the forms for concrete columns, which forms are capable of supporting the weight of the precast slab, and the other construction loads which may be superimposed during construction. Holes thru the precast floor slab provide access to pour the concrete column thru the floor; and reinforcing bars in the floor slab extend thru the holes in the slab; and reinforcing bars from the columns extend vertically thru the holes in the floor slab, so that the bars cross and provide continuity of the reinforcing bars thru the holes, and into the column cast above. The hole is smaller than the column, so that the floor slab bears on the column cast thru the hole.

In addition to the column forms, beam form may be placed between the column forms, with access to pouring the beams provided by a series of holes in the floor slab located directly above the beam form location. The reinforcing in this beam would overlap the reinforcing in the column to provide a fixed end condition for the beam, and so develop a structural frame action. This frame, in consort with the frame developed for the next above and next beside frames, can provide the ductile frame required for the high rise building. Since there is no design restraint on the size of the column or the beam, the required size may be easily provided. By inserting reinforcing bar stirrups thru the holes in the floor slab, which stirrups will cross the reinforcing bars in the holes in the floor slab, and lapping these stirrups with the reinforcing bars in the beam, a composite "T" beam is developed, with the concrete poured thru the holes providing the means of transferring the shearing stresses between the leg of the "T" and the floor slab.

In the above disclosure, the column forms may be braced to provide lateral stability to the floor slab during erection. An alternate method of providing lateral stability, may be achieved by utilizing precast concrete walls hingeably connected to the precast floor slaabs; which walls fold down by gravity when the floor slab is lifted, and which walls, when lowered onto a supporting surface, would provide the lateral stability.

The present invention permits the casting of the floor slabs according to the teaching of Johnson '092, and Johnson '512.

The present invention includes the following advantages over the preveous art:

1. Provides the means to develop a ductile frame for a high rise building, and thus take advantage of the building code requirements, wherein the required lateral design load factor is reduced from 1.33 to 0.67.

2. Provides the means for developing large clear floor free from the bearing walls as required in Johnson '092, and '512, with the additional benefit of reducing the lifted weight.

3. Reduces the amount of grouting required at the bearing concrete walls.

4. Reduces the problems resulting when two adjacent folding walls are of slightly different heights (resulting from poor workmanship)

5. Eliminates the dependency of the structural design upon welded connections, by virtue of the continuity of the steel reinforcing bars vertically thru the columns, and the securing of the horizontal reinforcing bars to these bars by the embedment in the concrete of the columns.

6. Provides the means to meet the code requirements for buildings higher than 160 feet high.

7. Simplifies the design task of providing higher ground floor ceiling heights, by virtue of eliminating more than 50% of the walls required, thus providing more room for casting the higher walls as in Johnson '512.

BRIEF DESCRIPTION OF THE DRAWINGS

FIG. 1, shows a stack of precast floor slabs 1, to which, optionally, are hingeably connected walls 16, and 17. Thw crane is ahown lifting a module 3 over module 4 on which column forms 8, 11, are shown erected and ready to receive and support the floor slab of module 3.

FIG. 2, shows the detail section of the column form and the hole in the floor slab.

FIG. 3, shows a detail section of the beam, the column, and the hole in the floor slab.

FIG. 4, shows a detail of a joint in a precast wall panel, separating the edge of the wall from the main body of the wall, so that the edge of the wall may function as a column, without introducing shearing forces into the main body of the wall.

DETAILED DESCRIPTION OF THE DRAWINGS

FIG. 1 Shows a building foundation 4A, over which a module 4, has been erected. Columns 6 and 7, are shown with the forms used during erection, removed. The crane 2, has lifted module 3 from its cast position on top of stack 1, and is about to lower it onto column forms 8 and 11, and beam form 12, all of which are in position. Walls 16 and 17 are shown depending from slab 3, and when lowered, will rest on walls 18 and 19 to provide lateral stability, and to accurately position slab 3 directly above slab 4. It would be possible to provide lateral bracing between the column forms, and thus eliminate the dependancy on the walls for this lateral stability. Holes 13 and 14 are located so that they will come directly over the column and beam forms 8, 11, and 12; so that reinforcing steel may be inserted thru the holes, and then concrete poured thru the holes into the forms to form the columns. Once the concrete is set and has developed the required strength, the forms may be removed and used at another location; alternately, several floors might be cast at the same time. FIG. 1, also shows a panel 20, folded down from floor slab 5, to form a side wall for a light well or a stairway.

FIG. 2 shows column form 21, with vertical members 21 capable of supporting the weight of slab 1, and the other construction loads. A block 25, is shown under the column form, and would be utilized to facilitate the removal of the column form after the concrete has set, by knocking block 25 out from under the form, and so developing a vertical clearance.

Reinforcing bars 22, and 23 are shown extending thru hole 13 provided in slab 1, lapping reinforcing bars 24, (shown diagramatically), with concrete 6A, poured to complete the column. Reinforcing bars 24C provide continuity into the foundation. Bars 24, may be inserted after the concrete is poured into the column forms, but while it is still fresh, and thus make it easier to properly fill the column. A collar clamp 26 is shown and would be used to withstand the horizontal force of the concrete during the concrete pour.

FIG. 3 shows beam 27 with reinforcing bars extending into the column and lapping the reinforcing bars in the column to permit the development of a rigid connection. Reinforcing bars 28 and 29 are cast in the floor slab and extend thru the holes 13 and 14 provided in the floor slab. Reinforcing bars 30 comprise stirrup connections inserted thru holes 14, to anchor the beam to the floor slab, and provide for the transfer of shear from the beam into the floor slab. Reinforcing bars 24, extend thru hole 13, vertically to provide for continuity into the next above poured column.

Block member 25, may be a wedge shape in section, to provide for minor height adjustment of the column form. It is a primary requirement that each successive floor of the total building be adjusted to level.

The above description discloses the manner of developing the composite beam, and the manner of providing vertical control, independent of the grout beds occurring under the bearing walls as is required in Johnsom '092 and Johnson '512.

FIG. 4 shows a plan section of the edge of wall 16, showing a joint 33, filled with a compressible material 34. This joint permits the portion 31 to act as a column section independent of wall section 32; so that the wall section 32 will not interfere with the frame action of the column in withstanding lateral forces. It is recognized that an engineer may desire to utilize some of the folding walls for shear where he elects to design the building with some of the shear taken by the walls and some of the shear taken by the frame provided. The present invention is intended to provide the engineer with a maximum of lattitude in this regard.

In summary, it is believed that the present invention discloses a new and novel improvement to the known methods of constructing concrete buildings that is practical and economical, and extends the height limitations in design. The fact that developers from England, from Singapore, and from Turkey are currently requesting the inventor to disclose the means to construct high rise buildings utilizing the advantages of his patents '092, and '512 should establish the fact that the present invention is not obvious to those skilled in the art of building construction.

What is claimed is:

1. Method of constructing and erecting a concrete building including the steps of:

a. constructing a foundation for the building, and b. erecting on top of said foundation at least two vertical loadbearing column forms including reinforcing bars for said columns extending downward into said foundation; and c. constructing a precast floor slab for said building, said floor slab being divided into modules of such size that in the erected building, said module would be supported on at least two of said column forms, and in addition at least two column holes in each of said modules, said column holes smaller in dimension than inside of said column forms; and slab reinforcing steel extending through said column holes in at least two directions; and d. lifting said slab over on top of and lowering said slab to bear on said column forms and said column forms supporting weight of said slab plus required construction loads developed on top of said slab, with said column holes aligned with said column forms; and said slab comprises a working platform for workmen; and e. inserting column reinforcing steel downwards into said column holes and into said column forms, said column steel lapping steel in said column forms; and said column steel extending above said slab; and f. pouring concrete downward thru said column holes to fill said column forms and part of said column hole; and g. curing said concrete in said column forms to supportive strength; and h. removing said column forms .

2. Method of constructing a building according to claim 1, with the addition of lateral column bracing, said bracing extending between said column forms, and said bracing of sufficient strength and in such position to withstand lateral loads imposed by erection of said slab and said construction loads.

3. Method of constructing a building according to claim 1, with the addition of at least one beam form extending between said column forms, and openings in sides of said column forms to receive said beam forms, and sides of said beam forms extending upward to the line of underside of said slab; and beam reinforcing steel for said beam is placed within said form; and said beam steel extends through said column form; and said slab is placed ontop of said column forms; and in addition, a series of spaced apart beam holes in said slab, said beam holes in alignment with said beam form; and slab reinforcing from said slab, extends across said beam holes in at least two directions; and in addition, steel stirrup bars are inserted downward through said beam holes to engage said beam reinforcing steel; and upper ends of said stirrup steel engage said slab steel; and concrete is poured through said beam holes; and vibrated to solidly fill said beam form between said beam holes, and to the top of said slab; and said beam concrete is cured, and said beam form removed; and said beam and said slab comprise an effective "T" beam.

4. Method of constructing a concrete building according to claim 1, with the addition of casting at least two layers of said floor slabs, and said modules and said column forms are erected to comprise a multistory building.

5. Method of constructing a building according to claim 1, with the addition of at least one precast wall, said wall hingeably connected to said floor slab; and lifting said floor slab, causes gravity to rotate said wall slab to a vertical position, and placing said slab in position over said column forms brings wall into position over a support; and securing lower edge of said wall to said support; and said wall comprises lateral bracing for said slab during construction.

6. Method of constructing a concrete building according to claim 1, with the addition of at least one precast wall, said wall hingeably connected to a module of said floor slab, and end of said wall slab coincides in location with an edge of a column hole, and a side form of a column form, and an opening in side of said column form receives said end, and horizontal steel of said wall extends into said column form and laps said column steel; and pouring concrete through said column hole and into said column form secures said precast wall to said column and said slab.

7. Method of constructing a concrete building according to claim 1, with the addition of at least one precast concrete column wall, said wall hingeably connected to said slab; and a vertical strip along at least one edge of said column wall aligns with a beam hole in said slab, and reinforcing steel from said column strip is exposed at the top and bottom of said column wall to engage additional steel extending vertically through said column hole, and concrete poured through said hole secures said steel and said column to said slab; and in addition, a strip of expansive material isolates said column strip from said wall panel; and nominal amount of steel ties extend across said expansion joint securing said wall panel to said column strip.

8. Method of constructing a concrete building according to claim 7, with the addition of a horizontal beam strip along upper edge of said precast wall panel; said beam strip extending continuously to engage a column strip, and an expansion strip between said beam strip and said wall panel isolates said beam strip concrete from said wall panel; and nominal steel secures said wall panel to said beam strip; and said beam strip together with said column strips comprise a building frame.

* * * * *